US011465895B2

(12) United States Patent
Lee et al.

(10) Patent No.: US 11,465,895 B2
(45) Date of Patent: Oct. 11, 2022

(54) COLD WATER TANK

(71) Applicant: COWAY Co., Ltd., Gongju-Si (KR)

(72) Inventors: Jong-Hwan Lee, Seoul (KR); Hee-Do Jung, Seoul (KR); Hyun-Goo Kim, Seoul (KR); Yoo-Won Oh, Seoul (KR); Hyun-Woo Lee, Seoul (KR); Chung-Lae Kim, Seoul (KR); Chan-Jung Park, Seoul (KR); Woong Jung, Seoul (KR)

(73) Assignee: COWAY Co., Ltd., Gongju-Si (KR)

( * ) Notice: Subject to any disclaimer, the term of this patent is extended or adjusted under 35 U.S.C. 154(b) by 0 days.

(21) Appl. No.: 17/260,774

(22) PCT Filed: Jul. 8, 2019

(86) PCT No.: PCT/KR2019/008366
§ 371 (c)(1),
(2) Date: Jan. 15, 2021

(87) PCT Pub. No.: WO2020/017804
PCT Pub. Date: Jan. 23, 2020

(65) Prior Publication Data

US 2021/0292151 A1 Sep. 23, 2021

(30) Foreign Application Priority Data

Jul. 16, 2018 (KR) ..... 10-2018-0082175

(51) Int. Cl.
*B67D 1/08* (2006.01)

(52) U.S. Cl.
CPC ..... *B67D 1/0859* (2013.01); *B67D 1/0801* (2013.01); *B67D 2210/00039* (2013.01); *B67D 2210/00044* (2013.01)

(58) Field of Classification Search
CPC ..... B67D 1/0859; B67D 1/0801; B67D 2210/00039; B67D 2210/00044; F25D 2331/806; F25D 21/04
See application file for complete search history.

(56) References Cited

U.S. PATENT DOCUMENTS 2,533,930 A * 12/1950 Harr ..... B67D 3/0022 222/57
4,610,145 A * 9/1986 Arzberger ..... B67D 1/0028 62/127
2019/0127199 A1* 5/2019 Ozawa ..... B67D 1/0004

FOREIGN PATENT DOCUMENTS

CN 103134261 A 6/2013
CN 103848102 A 6/2014
(Continued)

OTHER PUBLICATIONS

International Search Report dated Oct. 14, 2019 in PCT/KR2019/008366 filed on Jul. 8, 2019, 2 pages.
(Continued)

*Primary Examiner* — Joseph F Trpisovsky
(74) *Attorney, Agent, or Firm* — Oblon, McClelland, Maier & Neustadt, L.L.P.

(57) ABSTRACT

A cold water tank includes a tank body, a cover part connected to the tank body to cover an open top of the tank body, and a cooling unit disposed in the tank body to cool water stored inside the tank body so as to make cold water. The cover part is configured to have an air layer formed therein, thereby minimizing or preventing the occurrence of condensation.

3 Claims, 5 Drawing Sheets

(56) References Cited

FOREIGN PATENT DOCUMENTS

| | | | |
|---|---|---|---|
| CN | 206207828 | U | 5/2017 |
| CN | 107625428 | A | 1/2018 |
| JP | 2001-174124 | A | 6/2001 |
| KR | 10-0853253 | B1 | 8/2008 |
| KR | 10-2009-0098362 | A | 9/2009 |
| KR | 10-2012-0076943 | A | 7/2012 |
| KR | 10-2016-0018942 | A | 2/2016 |
| KR | 10-2017-0061301 | A | 6/2017 |

OTHER PUBLICATIONS

Office Action dated Jun. 22, 2022, in Chinese Patent Application No. 201980047724.2, filed Jul. 8, 2019, with English translation, 13 pages.

* cited by examiner

COLD WATER TANK

TECHNICAL FIELD

The present invention relates to a cold water tank storing cold water.

BACKGROUND ART

A cold water tank is provided in a water purifier, or the like, and cools water stored therein to form cold water and supply the same to users.

Conventionally, a cold water tank provided in a water purifier, or the like, has been provided integrally or separately below a water purification tank in which room temperature purified water is stored. Accordingly, even when the water stored in the cold water tank is cooled to become cold water, a temperature difference with the room temperature purified water stored in the water purification tank is not large. This results in a small amount of condensation generated in the cold water tank or no occurrence of condensation.

However, in the case in which a water purification tank is not provided in a water purifier, or the like, and only a cold water tank is provided alone, a large amount of condensation may occur in the cold water tank.

DISCLOSURE

Technical Problem

The present invention is based upon recognition of at least one of the requirements or problems generated in the related art cold water tank as mentioned above.

An aspect of the present invention is to minimize or prevent occurrence of condensation even when a cold water tank is provided alone.

Another aspect of the present invention is to minimize or prevent occurrence of condensation by forming an air layer on a cover part of a cold water tank.

Technical Solution

A cold water tank related to an embodiment for realizing at least one of the above problems may include the following features.

According to an embodiment of the present invention, a cold water tank includes a tank body; a cover part connected to the tank body so as to cover an open top of the tank body; and a cooling unit provided in the tank body and configured to cool water stored inside the tank body to form cold water, wherein the cover part is configured such that an air layer is formed therein to minimize or prevent occurrence of condensation.

In this case, the cover part may include a main cover member connected to the tank body to cover the open top of the tank body.

In addition, the cover part may be configured such that the air layer is formed on at least one of a lower portion and an upper portion of the main cover member.

The cover part may further include a first supplementary cover member connected to a lower portion of the main cover member to form a first air layer.

Further, the first air layer may be provided with a heat-insulating member.

Meanwhile, the cover part may further include a second supplementary cover member connected to an upper portion of the main cover member to form a second air layer.

In addition, a remaining portion of the tank body, other than a portion connected to the cover part, may be configured to be surrounded by a heat-insulating member to minimize or prevent the occurrence of condensation.

Further, the cooling unit comprises an evaporation tube provided inside the tank body, and through which a refrigerant flows.

Advantageous Effects

As the above, according to an embodiment of the present invention, an air layer is formed in a cover part of a cold water tank to minimize or prevent occurrence of condensation.

Further, according to an embodiment of the present invention, occurrence of condensation may be minimized or prevented even when a cold water tank is provided alone.

MODE FOR INVENTION

Figure 1:
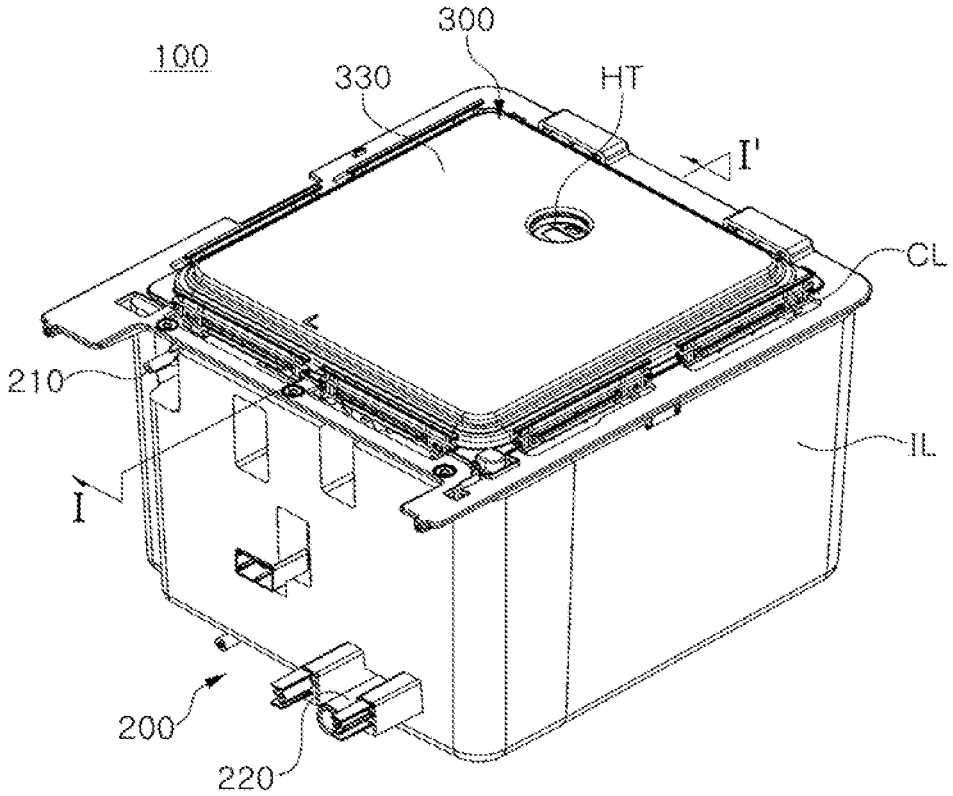
FIG. 1 is a perspective view of a cold water tank according to an embodiment of the present invention.

Hereinafter, a cold water tank related to an embodiment of the present invention will be described in detail to help understand the features of the present invention.

Hereinafter, embodiments most appropriate to help in an understanding of the technical features of the present invention will be described, the technical features of the present invention are not limited by the described embodiments and merely illustrate the implementation of the present invention through the embodiments described hereinafter. Thus, the present invention can be variably modified within the scope of the present invention through the embodiments described below, and such modifications are within the scope of the present invention. In order to help understand the embodiments described hereinafter, the like or similar reference numerals are used for relevant components among the components having the same function in the respective embodiments in the accompanying drawings.

Hereinbelow, a cold water tank 100 according to an embodiment of the present invention will be described with reference to FIGS. 1 to 5.

Figure 2:
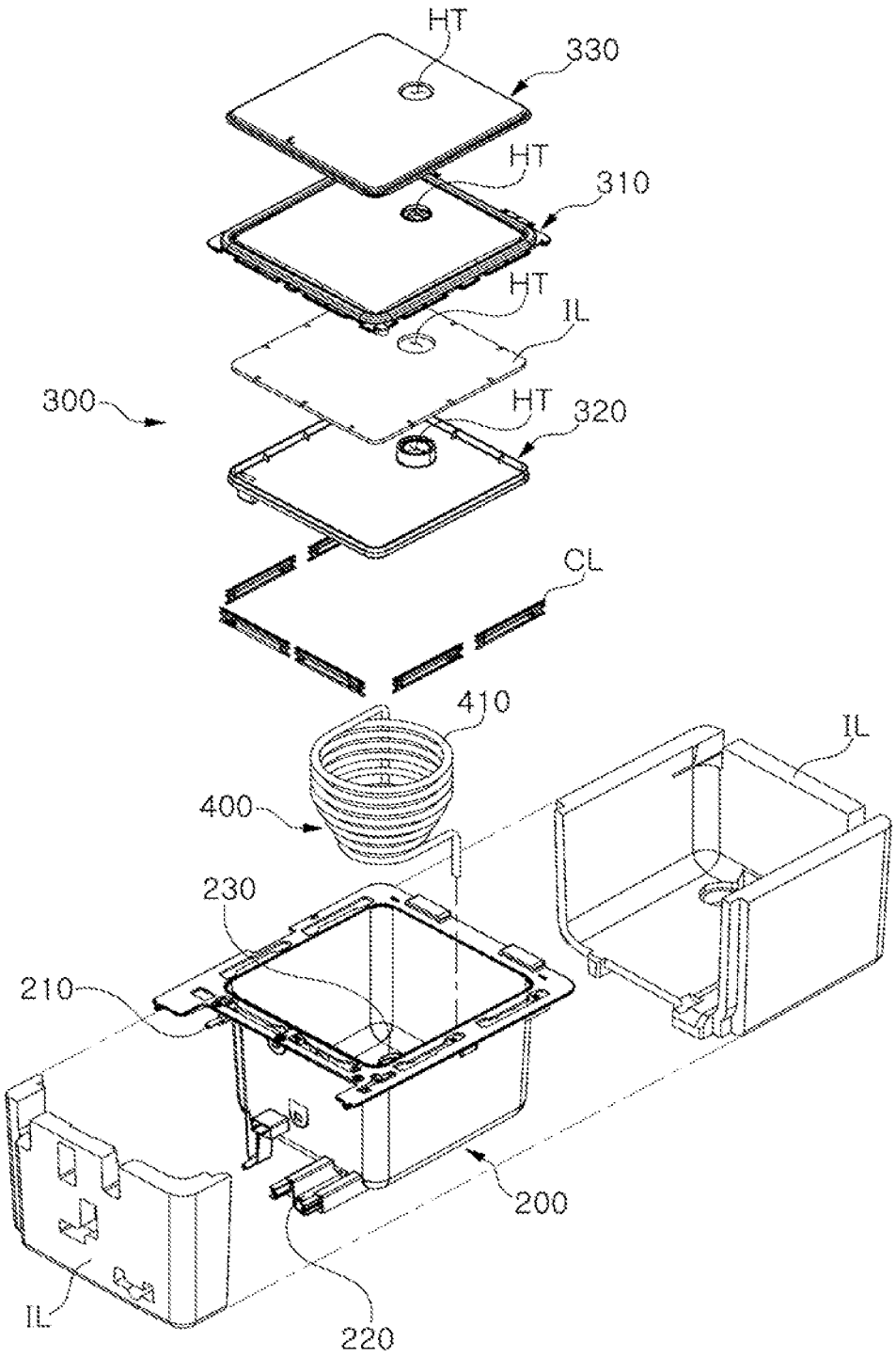
FIG. 2 is an exploded perspective view of a cold water tank according to an embodiment of the present invention.
Figure 3:
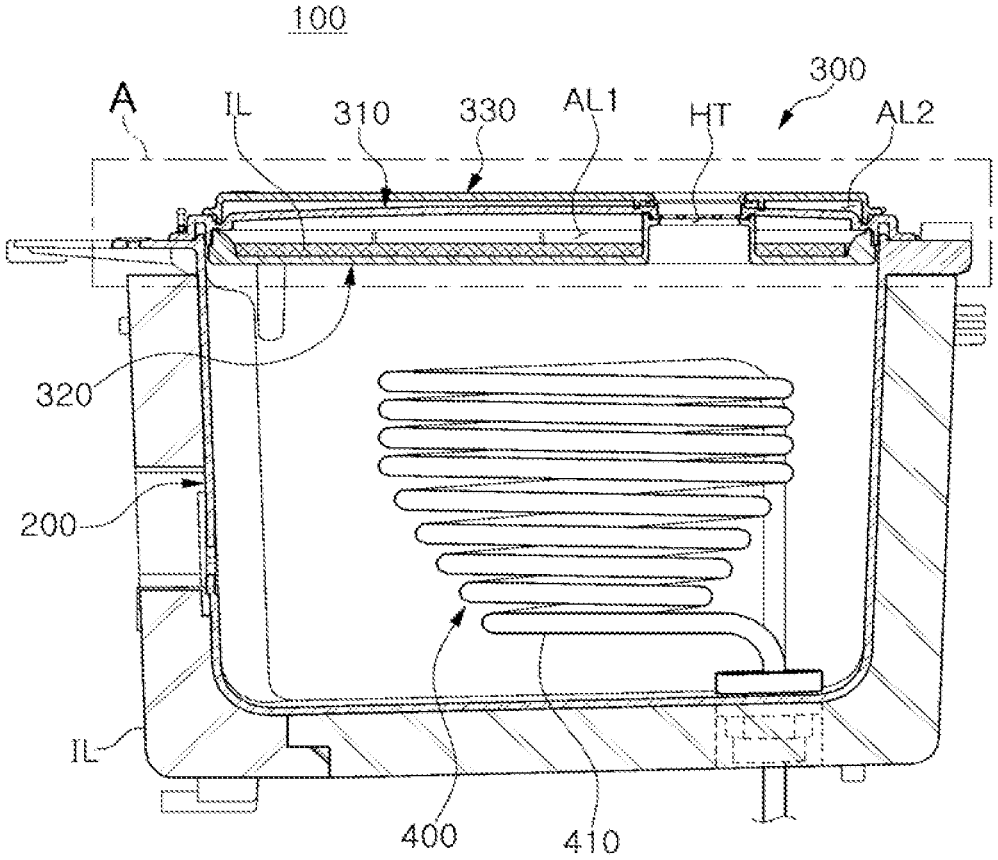
FIG. 3 is a cross-sectional view taken along line I-I' of FIG. 1.
Figure 4:
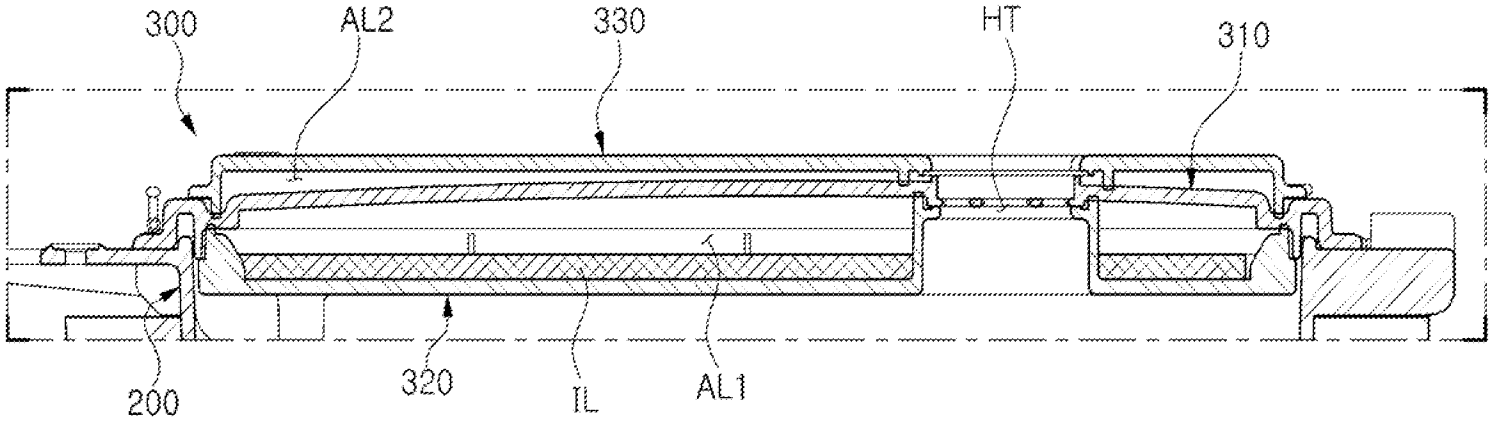
FIG. 4 is an enlarged view of "A" of FIG. 3.

FIG. 1 is a perspective view of a cold water tank according to an embodiment of the present invention, and FIG. 2 is an exploded perspective view of a cold water tank according to an embodiment of the present invention. FIG. 3 is a cross-sectional view taken along line I-I' of FIG. 1, and FIG. 4 is an enlarged view of "A" of FIG. 3.

Figure 5:
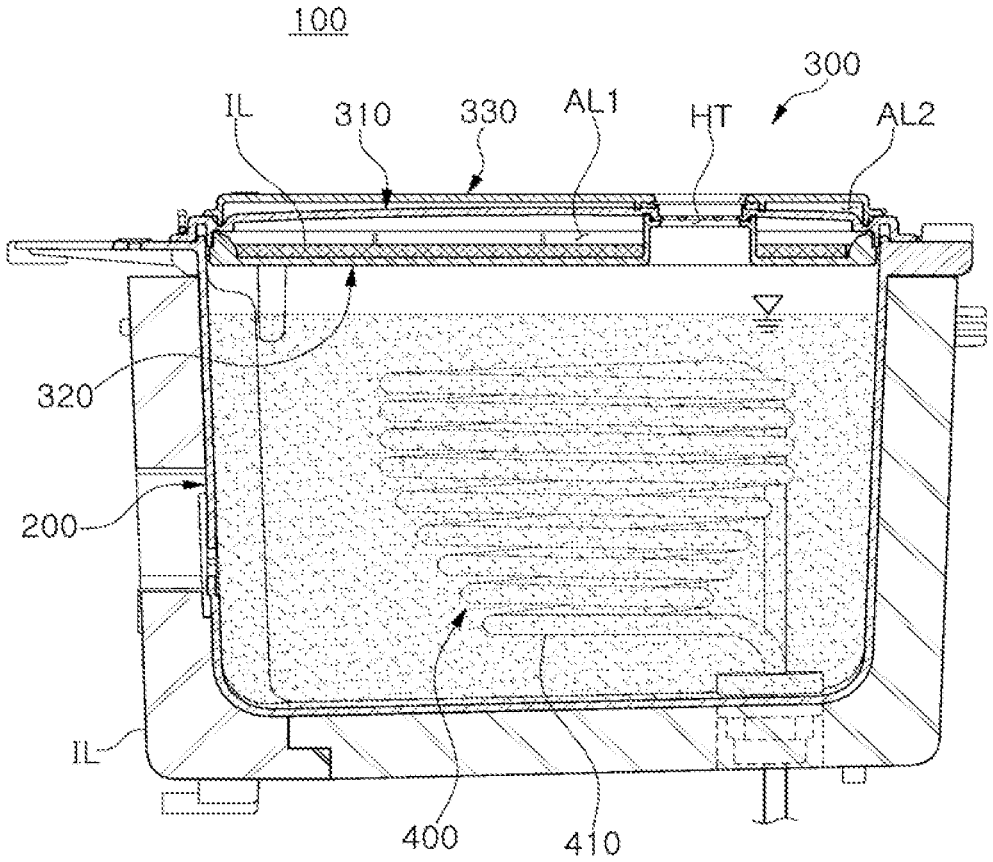
FIG. 5 is a cross-sectional view, as FIG. 3, illustrating a state in which a cold water tank according to an embodiment of the present invention is used.

In addition, FIG. 5 is a cross-sectional view, as FIG. 3, illustrating a state in which a cold water tank according to an embodiment of the present invention is used.

A cold water tank 100 according to an embodiment of the present invention may include a tank body 200, a cover part 300 and a cooling unit 400.

The tank body 200 may have a predetermined size of space formed therein and an open upper portion. Water may be stored in an inner space of the tank body 200 as illustrated in FIG. 5.

The tank body 200 may be provided with an inlet 210 connected to a water supply source (not illustrated) to allow water to flow into the tank body 200 from the water supply source. Accordingly, water from the water supply source may be introduced into the tank body 200 through the inlet 210 and stored therein. The water supply source, to which the inlet 210 is connected, may be, for example, a filtering unit (not illustrated) which includes a water filter (not illustrated) and filters water. However, the water supply source, to which the inlet 210 is connected, is not particularly limited, and any known water source is feasible as long as it is connected to the inlet 210 and capable of supplying water to the tank body 200.

As illustrated in FIG. 3, a cooling unit 400 may be provided inside the tank body 200. The tank body 200 has a through-hole 230 through which an evaporation tube 410, to be described later, included in a cooling unit 400 passes. In this regard, the cooling unit 400 may be provided therein. By the cooling unit 400, water stored in the tank body 200 may be cooled and become cold water as illustrated in FIG. 5.

The tank body 200 may be provided with an outlet 220. Accordingly, the cold water of the tank body 200 may be discharged to an outside through the outlet 220.

A configuration of the tank body 200 is not particularly limited. Any known configuration of the tank body 200 is feasible as long as the water from the water supply unit is introduced into and stored thereinside, and due to the cooling unit 400, the water stored inside is cooled by the cooling unit 400 and turns into cold water, and the cold water is discharged to the outside.

The cover part 300 may be connected to the tank body 200 to cover the open top of the tank body 200.

As illustrated in FIGS. 3 and 4, the cover part 300 may be configured such that air layers AL1 and AL2 are formed therein. An outside and an inside of the tank body 200 may be insulated by the air layers AL1 and AL2 of the cover part 300. Therefore, the occurrence of condensation due to a temperature difference between the outside and the inside of the tank body 200 can be minimized or prevented.

The cover part 300 may include a main cover member 310. The main cover member 310 may be connected to the tank body 200 to cover the open top of the tank body 200. For example, one sides of a plurality of clip members CL may be connected to a periphery of an upper end of the tank body 200, as illustrated in FIG. 2. In addition, the main cover member 310 may be connected to the tank body 200 so as to cover the open top of the tank body 200 by connecting each of the other sides of the plurality of clip members CL to the main cover member 310. However, the configuration in which the main cover member 310 is connected to the tank body 200 so as to cover the open top of the tank body 200 is not particularly limited, and any known configuration may be employed.

The cover part 300 may be configured such that air layers AL1 and AL2 are formed on at least one of lower and upper portions of the main cover member 310. However, a number of the air layers AL1 and AL2 formed in the cover part 300 is not particularly limited, and any number thereof may be used as long as the number can insulate the interior and the exterior of the tank body 200 from each other to prevent condensation.

The cover part 300 may further include a first supplementary cover member 320. The first supplementary cover member 320 may be connected to the lower portion of the main cover member 310 to form a first air layer AL1. The first supplementary cover member 320 may be connected to the lower portion of the main cover member 310 by fitting. However, the configuration in which the first supplementary cover member 320 is connected to the lower portion of the main cover member 310 is not particularly limited, and any known configuration is feasible as long as the first supplementary cover member 320 is connected to the lower portion of the main cover member 310 so as to form the first air layer AL1.

The first air layer AL1 formed by the main cover member 310 and the first supplementary cover member 320 may be provided with an insulating member IL as illustrated in FIGS. 3 and 4. In this regard, a heat insulation effect by the first air layer AL1 may be improved. The heat insulating member IL is not particularly limited, and any heat insulating member can be used as long as it is provided on the first air layer AL1 formed by the main cover member 310 and the first supplementary cover member 320 to improve the heat insulation effect by the first air layer AL1.

The cover part 300 may further include a second supplementary cover member 330. The second supplementary cover member 330 may be connected to the upper portion of the main cover member 310 to form a second air layer AL2. The second supplementary cover member 330 may be connected to the upper portion of the main cover member 310 by fitting. However, the configuration in which the second supplementary cover member 330 is connected to the upper portion of the main cover member 310 is not particularly limited, and any known configuration is employed as long as it is connected to the upper portion of the main cover member 310 so as to form the second air layer AL2.

As illustrated in FIGS. 2 to 4, the main cover member 310, the first and second supplementary member 320 and 330, and the insulation member IL provided in the first air layer AL1 formed by the main cover member 310 and the first supplementary cover member 320 may be provided with through-holes HT communicating with each other and allowing the inside and the outside of the tank body 200 to communicate. When water is introduced into the tank body 200 and stored through the communication hole HT, air inside the tank body 200 may be discharged to the outside. In addition, when the cold water inside the tank body 200 is discharged to the outside through the communication hole HT, air from the outside may be introduced into the tank body 200. Accordingly, inflow of water into the tank body 200 and discharge of cold water from the tank body 200 can be carried out easily. Meanwhile, the communication hole HT may be formed in the main cover member 310, the first and second supplementary member 320 and 330, and the insulation member IL provided in the first air layer AL1 formed by the main cover member 310 and the first supplementary cover member 320, so as not to communicate with the air layers AL1 and AL2.

A remaining portion of the tank body 200, other than a portion connected to the cover part 300, may be configured to be surrounded by the insulation member IL as illustrated in FIGS. 1 to 2. In this regard, the occurrence of condensation may be minimized or prevented in the portion of the tank body 200 other than the portion connected to the cover part 300. The insulation member IL is not particularly limited, and any insulation member can be employed as long as it is provided to surround the portion of the tank body 200 other than the portion connected to the cover part 300 and prevents condensation from occurring in the portion of the tank body 200, other than the portion connected to the cover part 300.

The cooling unit 400 may be provided in the tank body 200 to cool the water stored in the tank body 200 to form cold water. The cooling unit 400 may be provided inside the tank body 200 as illustrated in FIG. 3. However, the cooling unit 400 may be provided outside the tank body 200.

As illustrated in FIGS. 2 and 3, the cooling unit 400 may include an evaporation tube 410. The evaporation tube 410 may be provided inside the tank body 200 through a through-hole 230 formed in the tank body 200. A refrigerant may flow through the evaporation tube 410. In addition, water stored in the tank body 200 may be cooled and become cold water by heat transfer from the water stored in the tank body 200 to the refrigerant flowing through the evaporation tube 410.

A configuration of the cooling unit 400 is not particularly limited, and any known configuration, such as a configuration including a thermoelectric module (not illustrated), can be employed as long as the configuration is provided inside the tank body 200 and allows the water stored inside the tank body 200 to become cold water.

As described above, when the cold water tank according to the present invention is used, an air layer is formed on a cover part of a cold water tank, thereby preventing condensation from occurring. Even when the cold water tank is provided alone, condensation may not occur.

The configurations of the above-described embodiments are not limitedly applicable to the cold water tank described above. All or part of the embodiments may be selectively combined so that various modifications can be made.

The invention claimed is:

1. A cold water tank, comprising:

a tank body;

a cover part connected to the tank body so as to cover an open top of the tank body and exposed externally of the tank body; and a cooling unit, including an evaporation tube, provided in the tank body and configured to cool water stored inside the tank body to form cold water, wherein the cover part is configured to have an air layer formed therein, thereby minimizing or preventing an occurrence of condensation, the cover part comprises a main cover member connected to the tank body to cover the open top of the tank body, a first supplementary cover member connected to a lower portion of the main cover member to form a first air layer between a lower surface of the main cover member and the first supplementary cover member, a second supplementary cover member connected to an upper portion of the main cover member to form a second air layer between an upper surface of the main cover member and the second supplementary cover member, and a heat-insulating member provided on an upper surface of the first supplementary cover member, and a communication hole is formed over the main cover member, the first supplementary cover member, the second supplementary cover member, and the heat-insulating member.

2. The cold water tank of claim 1, wherein a remaining portion of the tank body, other than a portion connected to the cover part, is configured to be surrounded by the heat-insulating member to minimize or prevent the occurrence of condensation.

3. The cold water tank of claim 1, wherein the cooling unit comprises the evaporation tube provided inside the tank body and is configured to have a refrigerant flow therethrough.

* * * * *